US009976747B2

(12) United States Patent
McClean

(10) Patent No.: US 9,976,747 B2
(45) Date of Patent: May 22, 2018

(54) SAFE VENTING CONTROL FOR STOVES

(71) Applicant: Adventures In Sustainability, LLC, Cottage Grove, OR (US)

(72) Inventor: Andrew Lawrence McClean, Cottage Grove, OR (US)

(73) Assignee: Adventures In Sustainability, LLC, Cottage Grove, OR (US)

( * ) Notice: Subject to any disclaimer, the term of this patent is extended or adjusted under 35 U.S.C. 154(b) by 128 days.

(21) Appl. No.: 15/002,983

(22) Filed: Jan. 21, 2016

(65) Prior Publication Data

US 2017/0211812 A1 Jul. 27, 2017

(51) Int. Cl.

| | |
|---|---|
| ***F24C 15/20*** | (2006.01) |
| ***F24B 1/26*** | (2006.01) |
| ***F24B 9/00*** | (2006.01) |

(52) U.S. Cl.
CPC ..... *F24B 1/26* (2013.01); *F24B 9/006* (2013.01)

(58) Field of Classification Search
CPC ..... F24C 15/2042; F24C 15/20
USPC ..... 126/2, 3, 28, 299 R, 300–301, 299 D, 126/299 F, 307 R, 307 A, 52
See application file for complete search history.

(56) References Cited

U.S. PATENT DOCUMENTS 2,999,450 A * 9/1961 Jackson ..... A47J 37/00 165/61
4,444,175 A * 4/1984 Reynolds ..... F24C 15/32 126/21 R

* cited by examiner

*Primary Examiner* — Vivek Shirsat
(74) *Attorney, Agent, or Firm* — Meng Ouyang

(57) ABSTRACT

A stove or a stove body has a trigger control that directs toxic fumes to the stovetop during cooking and to a side outdoor venting channel when cooking container is removed from the stovetop to ensure safe release of toxic fumes.

13 Claims, 6 Drawing Sheets

SAFE VENTING CONTROL FOR STOVES

CROSS-REFERENCE TO RELATED APPLICATIONS

This is an original U.S. patent application.

FIELD OF INVENTION

The invention is in the technical field of stoves. More specifically, this invention relates to a safe venting control for stoves that re-directs fumes for release into an outdoor environment when a cooking container is removed from stovetop, to prevent the release of harmful emissions into an indoor environment.

BACKGROUND

A significant danger of indoor cooking is air pollution by toxic emissions from fuel combustion. If not vented properly, harmful emissions can cause death in a closed environment. According to World Health Organization's report in 2014, harmful emissions from indoor cooking are responsible for 4 million death each year.

Some existing stoves may have a safe venting mechanism only while a pot is placed on stovetop. For example, sunken pot stoves, where harmful gas exhaust passing through gaps between a pot bottom and a stovetop is drafted into a gas outlet before it is safely released. However, sunken pot stoves do not have the ability to effectively prevent harmful exhaust gas from being released once a pot is removed, unless an open stovetop is manually closed or the cooking fire is put out.

Existing stoves purely rely on human actions to close a stovetop or to put out cooking fire in order to ensure safe emission of fumes when a cooking container is removed from a stovetop. However, it is impractical and inefficient to put out a fire and to start a new fire between each cooking. Additionally, people often forget to close a stovetop in between cooking sessions. In developing countries where people usually reside in a relatively small, crowded and closed environment without proper venting outlets, death can easily occur when a cook forgets to close an open stovetop between cooking sessions after a cooking container has been removed.

It is desirable to have a stove that has a mechanism to correlate the placement and removal of a cooking container on a stovetop with the proper venting outlets, such that toxic gas from fuel burning can be prevented from being released into an indoor area inadvertently. Such a mechanism will save lives.

SUMMARY

Embodiments of the invention correlate two configurations of a trigger control with the pressure or weight placed on top of a stovetop, and each configuration of the trigger control directs toxic burning emissions into a safe venting outlet, either during cooking or in-between cooking sessions. When the pressure or weight placed on the stovetop is zero or miniscule, i.e., no cooking container is placed on the stovetop, the trigger control adopts a configuration to immediately direct burning emissions into a chimney for outdoor release. When there is enough pressure or weight placed on the stovetop, e.g., the weight of a normal cooking container, small or big, the trigger control adopts a different configuration to direct heat and burning emissions to the stovetop for heating food in the cooking container, whereas the toxic burning emissions can be further drafted into a chimney for outdoor release using the sunken-pot stove concept.

BRIEF DESCRIPTION OF THE DRAWINGS

FIG. 1A shows the invention from one perspective and with a cooking container placed on the stovetop. FIG. 1B shows the invention from a different perspective and without a cooking container.

DETAILED DESCRIPTION

Figures 1A, 1B:
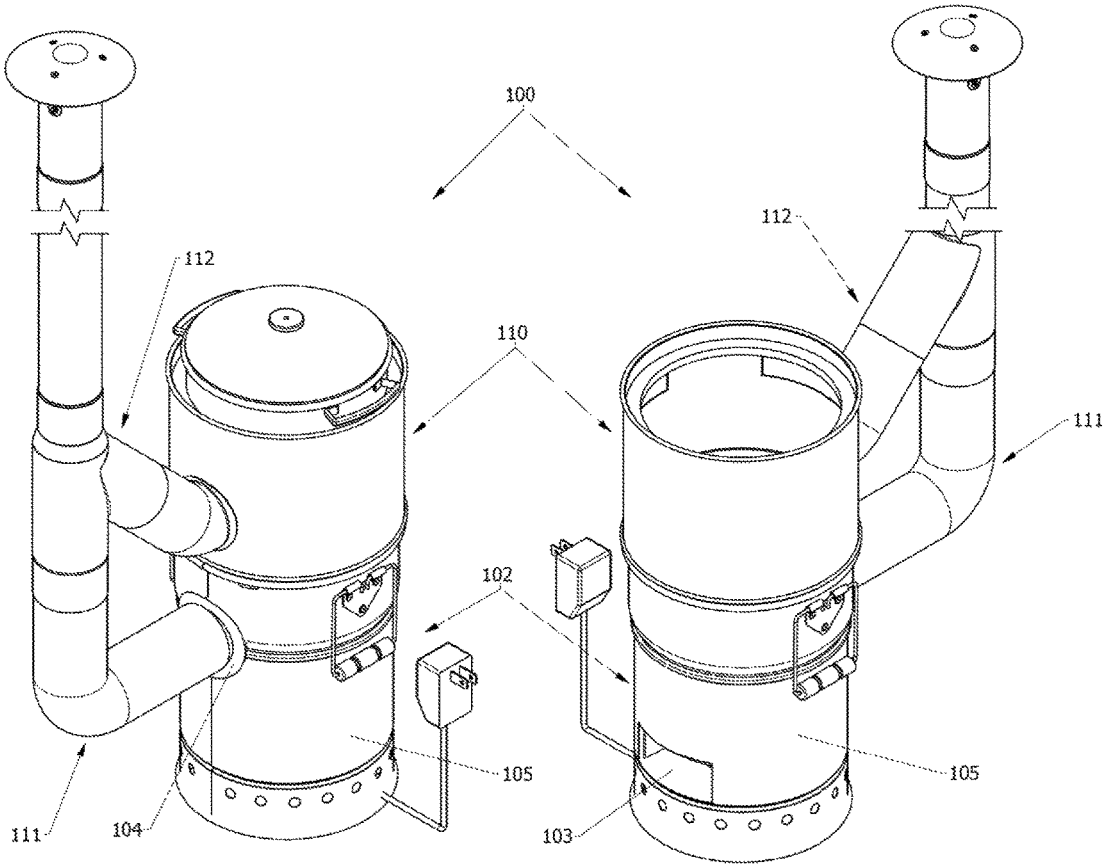
FIGS. 1A and 1B are perspective views of an embodiment of the stove.

FIGS. 1A and 1B are perspective views of an embodiment of a stove, 100. The stove 100 comprises a stovetop 101 (not visible in FIGS. 1A and 1B) and a stove body 102. The stove body 102 has a combustion chamber 103 to combust fuel and an exhaust chamber 200 (not visible in FIGS. 1A and 1B), which are encased by an enclosed wall 105. A first chimney 111 is connected to a side opening 104 of the stove body 102 for releasing exhaust gas directed through the side opening 104.

In the embodiment shown in FIGS. 1A and 1B, a sunken-pot case 110 is placed over the stovetop 101. A second chimney 112 extends from the sunken-pot case 110 and joins the first chimney 111. Although it is possible to use the stove 100 without the sunken-pot case 110 and the second chimney 112, it is desirable to include the sunken-pot case 110 and the second chimney 112 for better venting of exhaust gas during cooking. While the first chimney 111 and the second chimney 112 may be completely separate, it is desirable to join the first chimney 111 and the second chimney 112 to reduce material cost in manufacturing the stove 100.

Figure 2B:
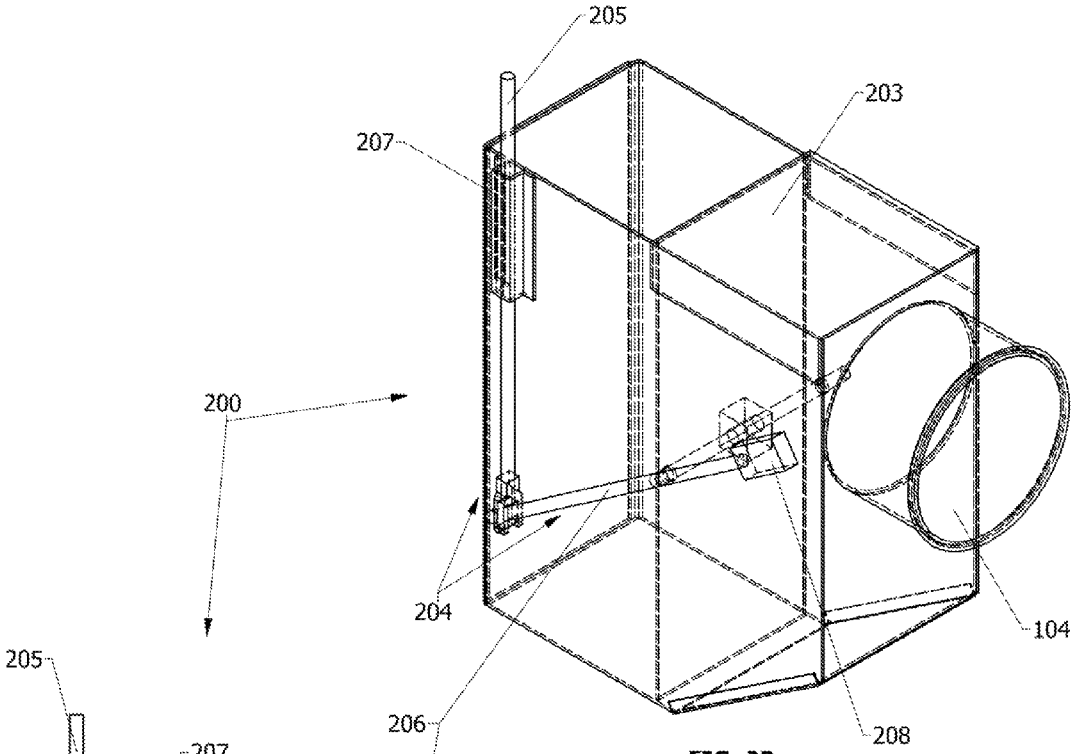
FIG. 2B is a perspective view of the same embodiment of the exhaust chamber shown in FIG. 2A.
Figure 2A:
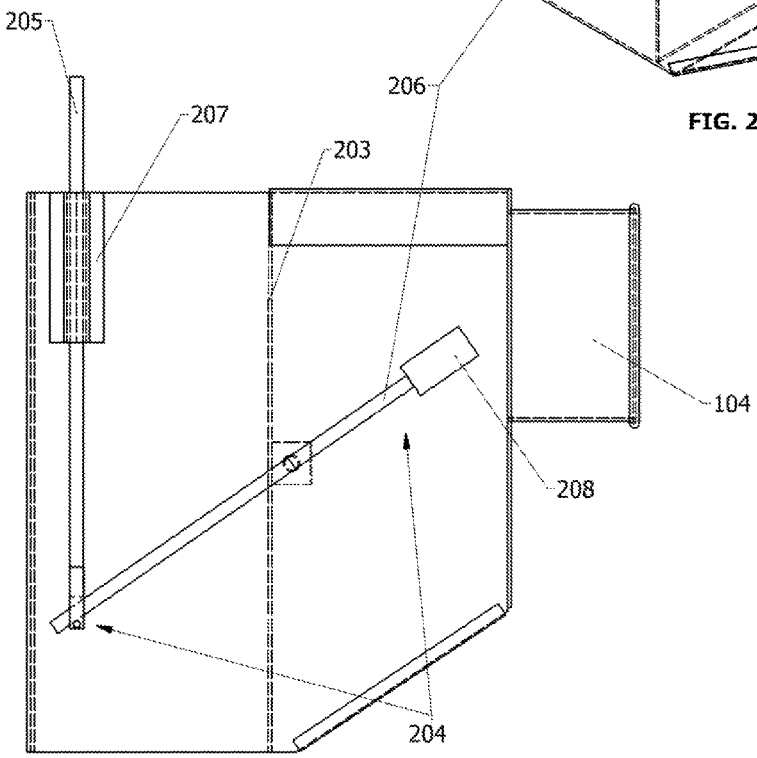
FIG. 2A is a side view of an embodiment of the exhaust chamber of the stove body.
Figure 3A:
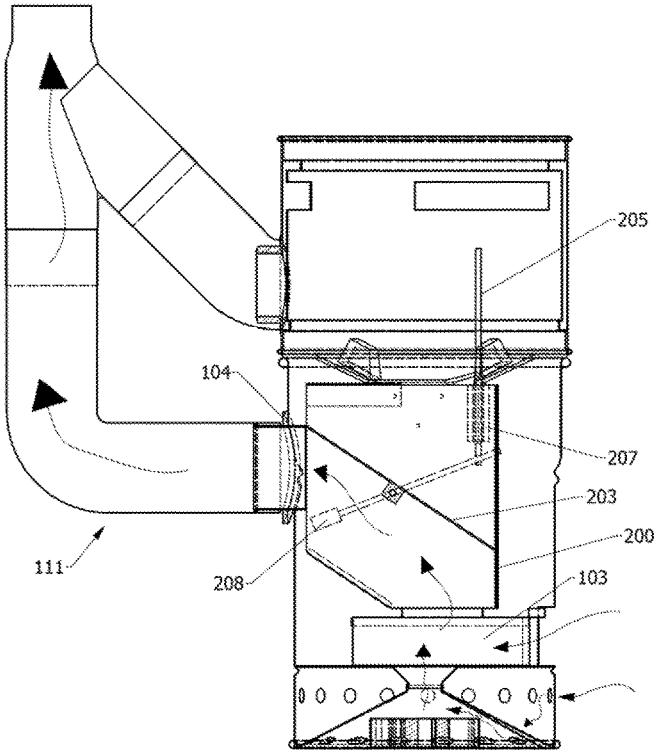
FIG. 3A is a cross section view from the side of an embodiment of the stove, with the flap or gate at the side-release position, showing the flow scheme of fumes into a side chimney.
Figure 3B:
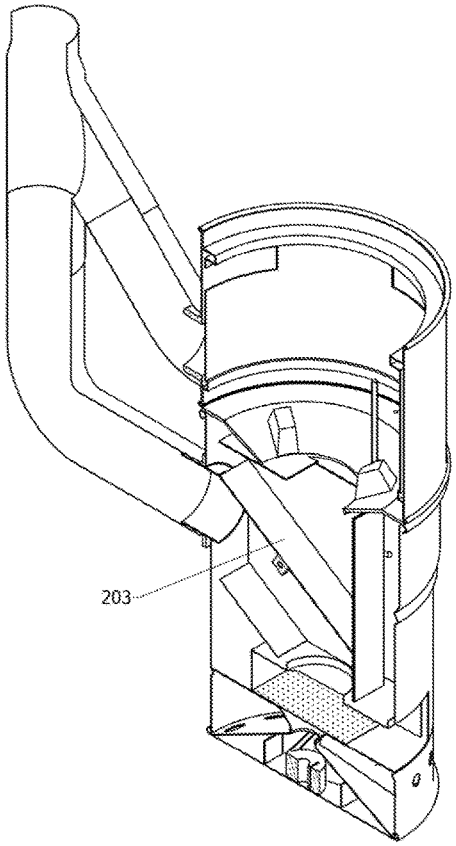
FIG. 3B is a sectional elevation view of the same embodiment of the stove in FIG. 3A, with the trigger control not being entirely visible.

FIGS. 2A and 2B are views of exhaust chamber 200 with a flap or a gate 203, and a trigger control 204. In one embodiment, the trigger control 204 comprises a vertical bar 205, a lever 206, a guide 207, and a counter-balance member 208. In the embodiment shown in FIGS. 2A and 2B, the counter-balance member 208 is a weight. In a different embodiment as shown in FIGS. 5A, 5B, 6A and 6B, the counter-balance member 208 is a spring.

Figure 4A:
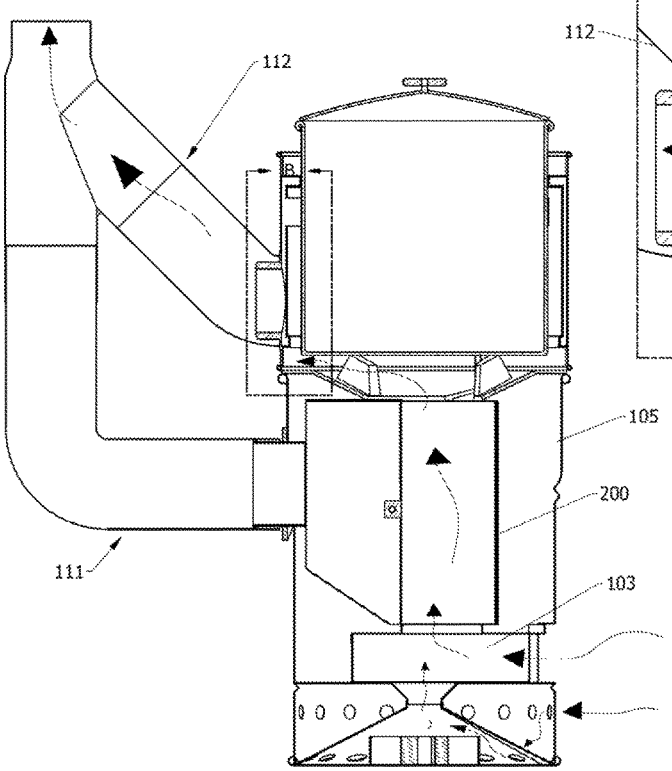
FIG. 4A is a cross section view from the side of an embodiment of the stove, with the flap or gate at the stovetop-release position, showing fumes and heat rising through the stovetop and a cooking container placed on the stovetop and into a sunken-pot case.
Figure 4C:
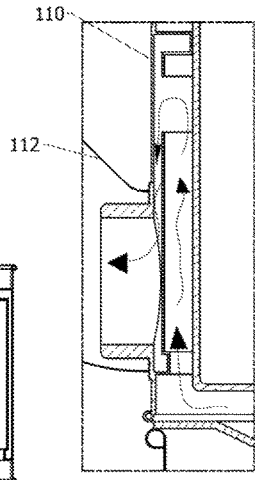
FIG. 4C is a focus cross section view of the area marked as "B" in FIG. 4A, which is a portion of the sunken-pot case, showing exhaust gas and residual heat flow released through the stovetop into the sunken-pot case, being further drafted into a chimney.
Figure 4B:
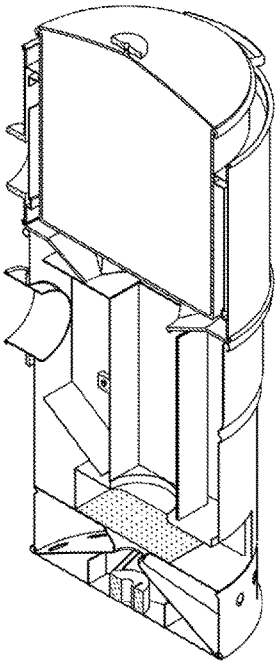
FIG. 4B is a sectional elevation view of the same embodiment of the stove in FIG. 4A.
Figures 5A, 5B:
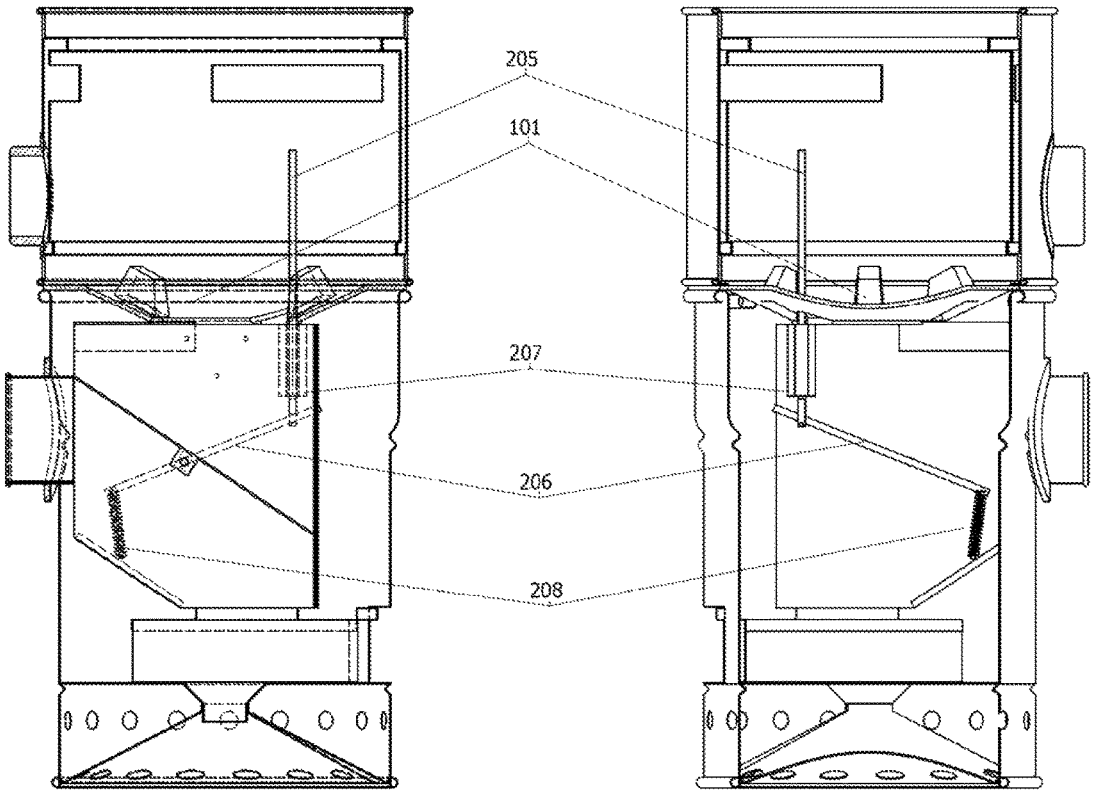
FIGS. 5A and 5B are cross section views of an embodiment of the stove from opposite sides, with the trigger control comprising a spring and the flap or gate is at the side-release position.
Figures 6A, 6B:
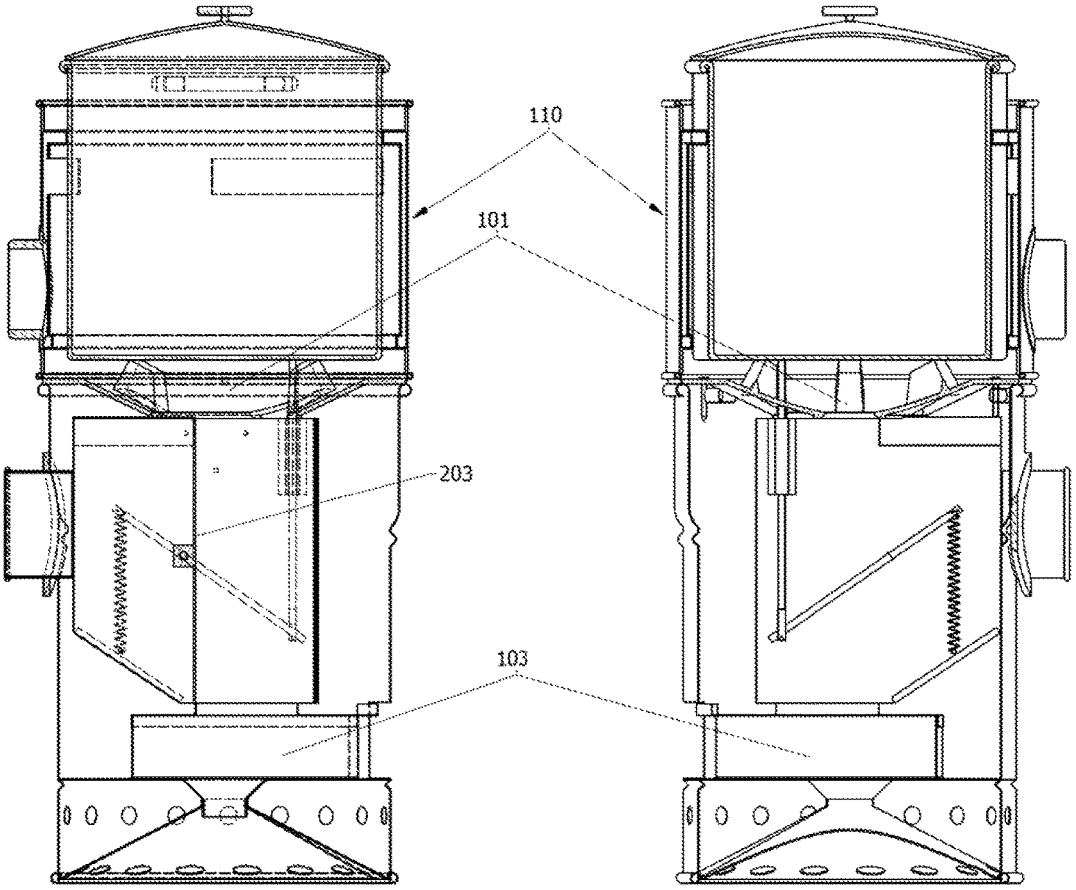
FIGS. 6A and 6B are cross section views of the same embodiment of the stove in FIGS. 5A and 5B, with the flap or gate at the stovetop-release position.

When enough pressure or weight is placed on the stovetop 101 (for example, the weight of a cooking container), the pressure or weight causes the vertical bar 205 to move downward with limited horizontal movement as restricted by the guide 207, resulting in the coordinate movement of the trigger control 204 by overcoming the counter-balance 208 (either the weight of a weight or the tension of a spring as shown in FIGS. 6A and 6B), which moves the flap or gate 203 to a stovetop-release position. Gas exhaust and heat generated from the combustion chamber 103 rise to the stovetop 101 to heat the food in the cooking container. If the stove 100 is not built to include the sunken-pot case 110 and the second chimney 112, a small amount of fumes will be released through the stovetop 101 during cooking. If the stove 100 is built to include the sunken-pot case 110 and the second chimney 112, fumes released through the stovetop 101 will be further drafted into the second chimney 112 for safe outdoor release, as shown in FIGS. 4A and 4C.

When there is no pressure or weight (or when there is a miniscule amount of pressure) placed on the stovetop 101, for example, when a cooking container is removed, as shown in FIGS. 3A, 3B, 5A and 5B, the trigger control 204 moves the vertical bar 205 upward with limited horizontal movement as restricted by the guide 207, via coordinate movement of the lever 206 and the counter-balance member 208 (if the counter-balance member 208 is a weight, the weight moves downward due to gravity; if the counter-balance member 208 is a spring, the spring has the tension to return to its original form), which configures the flap or gate 203 to a side-release position, such that fumes and heat generated from the combustion chamber 103 are directed through the side opening 104 into the first chimney 111.

The trigger control 204 is preferably made of a heat resistant material. It is desirable to mount the trigger control 204 inside the wall 105 for aesthetic reason. However, the trigger control 204 may be located outside of the wall 105 for ease of maintenance and repair, in which embodiment, a case (not shown in the figures) can be built to cover the portion of the trigger control 204 exposed outside of the wall 105.

When the vertical bar 205 moves up and down, the guide 207 provides an appropriate amount of horizontal space such that the vertical bar 205 can move to its upmost position to ensure the side-release position of the flap or gate 203, and to its down-most position to ensure the stovetop-release position of the flap or gate 203. The horizontal space provided by the guide 207 depends on the cross section measurement of the vertical bar 205. In one embodiment, the vertical bar 205's cross section is a circle having a diameter of 4 mm and the horizontal space's cross section is a rectangle having a dimension of 6 mm×5 mm.

If the counter-balance member 208 is a weight, the heaviness of the weight depends on the material and size of the trigger control 204. In one embodiment, the trigger control 204 is made of steel stock, both the vertical bar 205 and the lever 206 are cylindrical bars having a cross section diameter of 4 mm and are 18 cm in length, and the counter-balance member 208 weighs 300 g.

In one embodiment, the counter-balance member 208 is detachable from the trigger control 204, making it easy to adjust or replace the counter-balance member 208, especially when the trigger control 204 is located outside of the wall 105. In yet another embodiment, the counter-balance member 208 is molded to the trigger control 204.

The combustion chamber 103 and the exhaust chamber 200 are preferably made of materials that resist and insulate heat. The wall 105 is preferably made of an insulate material.

It is noted that, as used in this specification and the appended claims, the singular forms "a," "an," and "the," include plural referents unless expressly and unequivocally limited to one referent. As used herein, the term "include" and its grammatical variants are intended to be non-limiting, such that recitation of items in a list is not to the exclusion of other like items that can be substituted or other items that can be added to the listed items.

Upon studying the disclosure, it will be apparent to those skilled in the art that various modifications and variations can be made in the invention and methods of various embodiments of the invention. Other embodiments will be apparent to those skilled in the art from consideration of the specification and practice of the embodiments disclosed herein. It is intended that the specification be considered as examples only. The various embodiments are not necessarily mutually exclusive, as some embodiments can be combined with one or more other embodiments to form new embodiments.

What is claimed is:

1. A stove comprising:

a) a stovetop;

b) a stove body comprising i) a combustion chamber to combust fuel;

ii) an exhaust chamber with a top opening leading to the stovetop, a side opening leading to a first chimney, and a flap mounted inside of the exhaust chamber, wherein the flap alternates between a side-release position and a stovetop-release position, wherein gas exhaust from the combustion chamber is released exclusively via the side opening into the first chimney when the flap is at the side-release position and exclusively to the top opening when the flap is at the stovetop-release position;

iii) a trigger control to control the flap, wherein if a cooking container is placed on the stovetop, the flap is at the stovetop-release position, and if no cooking container is placed on the stovetop, the flap is at the side-release position; and iv) an enclosed wall to encase the combustion chamber and the exhaust chamber;

c) a sunken-pot case mounted over the stovetop for enclosing the cooking container placed on the stovetop; and d) a second chimney extending from a side of the sunken pot case.

2. The stove of claim 1, wherein the first chimney and the second chimney join together.

3. The stove of claim 1, wherein the trigger control is mounted between the exhaust chamber and the wall.

4. The stove of claim 1, wherein the trigger control is mounted outside of the wall.

5. The stove of claim 1, wherein the trigger control comprises a vertical bar, a guide to guide the vertical bar's movement, a lever, and a counter-balance member.

6. The stove of claim 5, wherein the counter-balance member is a weight that weighs less than the cooking container above the stovetop.

7. The stove of claim 5, wherein the counter-balance member is a spring.

8. The stove of claim 5, wherein the counter-balance member is detachable from the trigger control.

9. A stove body for a cooking stove with a stovetop comprising:

a) a combustion chamber;

b) an exhaust chamber with a top opening, a first side opening leading to a first chimney, and an interior gate; and c) a trigger control to alternate the gate between a side-release position when a cooking container is not placed on the stovetop and a stovetop-release position when a cooking container is placed on the stovetop; and d) a sunken-pot case having a second side opening leading to a second chimney mounter over the stovetop.

10. The stove body of claim 9, wherein the trigger control comprises a vertical bar, a guide to guide the vertical bar, a lever, and a counter-balance member.

11. The stove body of claim 10, wherein the counter-balance member is a spring or a weight.

12. The stove body of claim 10, wherein the counter-balance member is detachable from the trigger control.

13. The stove body of claim 10, wherein the counter-balance member is molded to the trigger control.

* * * * *